US011173082B2

(12) United States Patent
Huprich

(10) Patent No.: US 11,173,082 B2
(45) Date of Patent: Nov. 16, 2021

(54) WHEELCHAIR FOOTREST

(71) Applicant: Michael Huprich, Scheinfeld (DE)

(72) Inventor: Michael Huprich, Scheinfeld (DE)

( * ) Notice: Subject to any disclaimer, the term of this patent is extended or adjusted under 35 U.S.C. 154(b) by 178 days.

(21) Appl. No.: 16/270,299

(22) Filed: Feb. 7, 2019

(65) Prior Publication Data

US 2019/0240092 A1 Aug. 8, 2019

(30) Foreign Application Priority Data

Feb. 8, 2018 (DE) ..... 20 2018 000 627.0

(51) Int. Cl.

| | |
|---|---|
| ***A61G 5/12*** | (2006.01) |
| ***A61G 5/10*** | (2006.01) |
| ***A61G 5/02*** | (2006.01) |

(52) U.S. Cl.

CPC ..... *A61G 5/128* (2016.11); *A61G 5/022* (2013.01); *A61G 5/10* (2013.01); *A61G 5/1054* (2016.11); *A61G 5/1051* (2016.11); *A61G 5/1059* (2013.01); *A61G 5/127* (2016.11); *A61G 2203/70* (2013.01)

(58) Field of Classification Search

CPC ..... A61G 5/127; F21S 41/141

See application file for complete search history.

(56) References Cited

U.S. PATENT DOCUMENTS

| | | | | | |
|---|---|---|---|---|---|
| 4,569,002 | A * | 2/1986 | English | B60Q 1/0005 | 362/543 |
| 5,193,633 | A * | 3/1993 | Ezenwa | A61G 5/006 | 180/271 |
| 5,785,340 | A * | 7/1998 | Dias | A61G 5/1054 | 280/1.23 |
| 6,032,972 | A * | 3/2000 | Dias | A61G 5/10 | 280/1.13 |

(Continued)

FOREIGN PATENT DOCUMENTS

| | | |
|---|---|---|
| CN | 103356347 | 10/2013 |
| CN | 104905917 | 9/2015 |

(Continued)

OTHER PUBLICATIONS

CN 205866981 English Translation of Description (Year: 2020).*

(Continued)

*Primary Examiner* — Minnah L Seoh
*Assistant Examiner* — Myles A Harris
(74) *Attorney, Agent, or Firm* — Hartman Titus PLC; John D. Titus

(57) ABSTRACT

The present invention relates to a wheelchair footrest 1, comprising a continuous foot support 10 or two separate foot supports 10 for supporting the feet of a user; and at least one lighting means 20; wherein said lighting means 20 is fixedly arranged on at least one of said foot supports 10 to illuminate at least a floor area 40 on a front side 102 of said wheelchair 100; and the lighting means 20 comprises an LED strip (Continued)

which is fixedly arranged on the underside 12 of the at least one foot support 10, and wherein the LED strip has a length BL which extends over at least 50% of the width B of the at least one foot support 10. The present invention relates also to a wheelchair 100 comprising a corresponding wheelchair footrest 1.

13 Claims, 6 Drawing Sheets

(56) References Cited

U.S. PATENT DOCUMENTS

| | | | | |
|---|---|---|---|---|
| 6,154,690 | A * | 11/2000 | Coleman | A61G 5/006 180/65.1 |
| 6,176,335 | B1 * | 1/2001 | Schaffner | A61G 5/043 180/65.1 |
| 6,508,580 | B2 * | 1/2003 | Collins | A45B 3/00 280/288.4 |
| 6,702,314 | B1 * | 3/2004 | Crose | A61G 5/10 280/304.1 |
| 9,675,507 | B1 * | 6/2017 | Wilson-Hunter | A61G 5/10 |
| 9,707,988 | B1 * | 7/2017 | Chanatski | B62B 9/005 |
| 2005/0200470 | A1 * | 9/2005 | Bracken | B62J 6/04 340/467 |
| 2006/0091663 | A1 * | 5/2006 | Jackson | A61G 5/10 280/755 |
| 2011/0209931 | A1 * | 9/2011 | Butts | A61G 5/027 180/12 |
| 2013/0187355 | A1 * | 7/2013 | Slorance | A61G 5/02 280/250.1 |
| 2015/0061258 | A1 * | 3/2015 | Flores | A61G 5/10 280/304.1 |
| 2015/0345717 | A1 * | 12/2015 | Gerpheide | F21S 4/22 362/158 |
| 2016/0120714 | A1 * | 5/2016 | Santos Benitez | F21V 21/00 362/473 |
| 2018/0003350 | A1 * | 1/2018 | Spriggins | F21V 19/0025 |
| 2018/0116882 | A1 * | 5/2018 | Shaw | F21S 43/26 |
| 2018/0292082 | A1 * | 10/2018 | Frankovich | A61G 5/1054 |
| 2019/0307619 | A1 * | 10/2019 | Moore | A61G 5/128 |

FOREIGN PATENT DOCUMENTS

| | | | | |
|---|---|---|---|---|
| CN | 205866891 U | | 1/2017 | |
| CN | 106821620 A | * | 6/2017 | |
| DE | 10147281 A1 | * | 4/2003 | B60Q 1/0017 |
| DE | 202007017672 | | 6/2008 | |
| GB | 2427674 A | * | 1/2007 | A61G 5/125 |
| JP | 002011177460 | | 9/2011 | |

OTHER PUBLICATIONS

AHBLQD Lever Nut, Wire Connector assortment pack Retrieved from Amazon (please see office action for hyperlink) Item available on (Nov. 27, 2017) (Year: 2017).*

Office Action Chinese IP Office Retrieved from Global Dossier (dated Jul. 12, 2021) (Year: 2020).*

* cited by examiner

WHEELCHAIR FOOTREST

TECHNICAL FIELD

The present invention concerns a wheelchair footrest and a wheelchair with such a wheelchair footrest.

PRIOR ART

Wheelchairs are technical aids that enable a person with limited mobility to be independently mobile in a larger environment. A wheelchair can be designed as a manual or electric wheelchair. With a manual wheelchair, the wheelchair user drives the two large wheels of the wheelchair with his own arms. Furthermore, manual wheelchairs are also known, which are equipped with electric force amplifiers. Such force amplifiers act directly on the wheel hubs and support the wheelchair user during the drive movement. The entire drive including electronics and accumulator is usually integrated in the two drive wheels.

In the case of an electric wheelchair, the wheelchair user need only actuate an appropriate control device on the wheelchair to move the wheelchair. An electric motor on the wheelchair then completely drives the wheels.

The electric motor on the wheelchair is powered by a power source which is also located on the wheelchair. This power source is usually a rechargeable accumulator. Due to the existing power source, electric wheelchairs often have lighting to increase the visibility and traffic safety of the electric wheelchair. The lighting is often mounted on the side armrests of the wheelchair and essentially radiates light forward so that the wheelchair user can be seen from afar.

The movement of the wheelchair is essentially dependent on the characteristics of the floor on which the wheelchair is moved. A comfortable movement of the wheelchair is usually possible on flat surfaces such as asphalt or paved roads and sidewalks. Small unevennesses on the way are dampened by the rubber tires of the wheelchair and can be driven over. Larger unevenness, such as potholes or larger stones, can, however, lead to a significant reduction in comfort and, in the worst case, can cause the wheelchair to tip over. Particularly in restricted or poor visibility conditions, such as at dusk or in the dark, such unevenness can pose a serious hazard to the wheelchair user.

With an electric wheelchair, in such poor visibility conditions, lighting can be used to improve visibility. With manual wheelchairs, however, it is desirable to keep the weight of the wheelchair as low as possible in order to keep the effort required for the wheelchair user to move the wheelchair as low as possible. Therefore, heavy additional components, such as a wheelchair battery and corresponding active lighting used in electric wheelchairs, are avoided.

It is therefore a task of the present invention to provide a wheelchair or a component thereof which overcomes the disadvantages mentioned above and enables a wheelchair user to drive safely even in poor visibility conditions.

SUMMARY OF THE INVENTION

The above problems are solved according to the invention by a wheelchair footrest incorporating features of the present invention.

In particular, the above problems are solved by a wheelchair footrest comprising a continuous foot support or two separate foot supports for supporting the feet of a user, and at least one lighting means, wherein the lighting means is fixedly arranged on at least one of said foot supports to illuminate at least a floor area on a front side of the wheelchair, and the lighting means comprises an LED strip which is fixedly arranged on the underside of the at least one foot support, and wherein the LED strip has a length which extends over at least 50% of the width of the at least one foot support.

A lighting device on at least one of the foot supports improves the wheelchair user's forward view of the floor area in front of the wheelchair, especially in poor visibility conditions such as darkness or twilight. The improved view of the floor area enables the wheelchair user to recognize uneven areas or other obstacles better and thus reduce the risk of accidents. In addition, the wheelchair is better seen in the dark, which improves passive safety.

The lighting can be easily retrofitted to existing wheelchairs thanks to its design as a wheelchair footrest. The installation of the lighting on one of the foot supports of the wheelchair protects the lighting from damage. The fixed attachment increases durability and prevents unintentional detachment from the wheelchair. In addition, the arrangement of the lightning on at least one or both foot supports makes it possible for the wheelchair user to illuminate the floor area in front of the wheelchair in the direction of travel glare-free and particularly well. Due to the very low arrangement of the lighting means and the almost horizontal incidence of light on the floor area, obstacles are illuminated particularly well and are therefore easily recognizable. In addition, the light source is mechanically well protected by the foot support and takes up almost no space on the wheelchair, which is especially important for manual wheelchairs that are often transported and also folded flat. This arrangement on a foot support also eliminates the risk of injury by the lighting means.

The light source comprises an LED strip, which is fixedly arranged on the underside of at least one foot support. The LED strip is usually an elongated arrangement of several individual LED lamps. These lamps are preferably installed in a fixed and protective housing. Such a strip can be easily mounted and is protected from damage from above by at least one foot support above it. In addition, a LED strip provides a wide and powerful light beam onto the floor in front of the wheelchair. Glare to the wheelchair user himself and to other road users is also avoided.

The preferred length of the LED strip is at least 50% of the width of the foot support. A LED strip as wide as possible illuminates a large, wide floor area on the front of the wheelchair. This improves the view of the wheelchair user and the overall light output of the wheelchair foot support.

Preferably, the lighting means comprises LED lighting means, particularly white LED lamps. LED lighting means have low energy consumption and high light output. As a result, a battery or accumulator operated LED lighting means can operate much longer than a conventional lighting means, such as a light bulb, due to the economical use of energy. Furthermore, the LED lighting means are very small and therefore space-saving and mechanically very robust, especially against vibrations. In addition, they generate a very bright light, which is well suited for illuminating an area.

Preferably, the LED strip comprises RGB LED lamps. With these RGB LED lamps, illumination in any color can be achieved. Preferably, both white and RGB LED lamps are provided in the LED light source, so that it is possible to switch between white and colored lighting.

Preferably, the lighting means is preferably shockproof and/or waterproof. This means that the lighting means functions under all operating conditions of the wheelchair, even in wet weather conditions. The impact resistance of the lighting means protects the internal LED lamps, so that their function and long-term reliability are guaranteed even when driving on uneven terrain and at shocks.

Preferably, the lighting means further comprises a diffuser sheet. The preferred LED lamps are usually point-shaped light sources, which often lead to irregular illumination, especially with elongated LED strips. A diffuser sheet is used to diffuse the light from the individual LED lamps. In particular, the impression of a homogeneous elongated lighting unit can be achieved. This ensures uniform illumination of the floor area, which makes it easier to identify irregularities on the floor and such cannot be confused with lighting irregularities.

Preferably, the lighting means further comprises an optics which directs light that would be emitted upwardly from the LED strip downwardly onto the floor area. This has the advantage that the track is illuminated even better and glare to other road users is further prevented. Preferably, the optics can consist of a translucent plastic material, to combine the effect of the diffuser foil with the directional effect of the optics.

Preferably, the wheelchair footrest further comprises a power supply, preferably a power supply with an accumulator. The power supply makes it possible to operate the lighting even when the wheelchair stands still, in contrast to a dynamo, for example, which only generates power when the wheelchair is moving. This allows the wheelchair to illuminate a floor area even when standing still. In addition, the wheelchair is also recognizable when standing still in the dark. Besides that, a power supply with accumulator is much more reliable than a dynamo, which as a mechanical component tends to fail. An accumulator also has the advantage that it is rechargeable. The accumulator in one version can also be detachably connected to the wheelchair so that it can be conveniently removed and connected to a power source without the wheelchair having to be near a power source.

Preferably, the power supply is arranged to be located on the underside of the wheelchair seat. There is usually enough space on the underside of the wheelchair seat to attach the power supply. Furthermore, the power supply is protected against environmental influences, especially against splash water from below and direct sunlight from above. Since the power supply is installed essentially at knee height, the user can easily reach it from the side or the back, e.g. to connect a charging cable.

Preferably, the lighting means is electrically connected to the power supply via sliding contacts arranged in or on the frame of the wheelchair. Sliding contacts form simple and reliable mechanically movable electrical connections. Various frame parts can be electrically connected via the sliding contacts, whereby the position of the frame parts in relation to each other can be varied. For example, the height of the foot support relative to the floor or to the wheelchair seat can be adapted to the height of the wheelchair user. If sliding contacts are arranged on the inside of the outer frame part when two especially tubular frame parts are inserted into each other, the sliding contact connection is additionally protected against damage and contamination from outside.

Preferably, the wheelchair footrest further comprises wiring between the lighting means and the power supply, wherein the wiring is at least partially installed within the wheelchair frame. The wiring enables a permanent and reliable power supply of the lighting means. If the wiring is laid within the wheelchair frame, it is protected from damage and weather influences and thus functional for a long time. By laying the wiring within the hollow wheelchair frame, it is easy to install and/or to retrofit an existing wheelchair.

Preferably, the wheelchair footrest comprises an electric switch for switching the lighting means on and off, wherein the switch can be installed in the frame of the wheelchair, preferably can be installed at the end of a tubular frame part. The switch in the frame is for the wheelchair user easy to reach and operate by hand. This allows the wheelchair user to quickly switch the lighting on and/or off when the situation requires it. The wheelchair user can operate the switch while seated, avoiding unnecessary or strenuous movements such as standing up or turning sideways. This increases comfort and ease of use.

The arrangement of the switch in the frame, especially at the end of a tubular frame part, is simple and space-saving and does not require any machining of the frame. In addition, the switch is protected from damage or weather influences, which improves the functionality of the switch and thus of the entire lighting system. In addition, the risk of injury to the wheelchair user is also reduced, as no parts protrude except for the switch itself.

Furthermore, the installation of the switch is easy, since only the closing cap has to be removed from the existing frame part and the switch is inserted instead.

Preferably, the wheelchair footrest has an electronic controller for controlling the lighting means, whereby the controller can be controlled via an APP on a smartphone or on a smartwatch or by a remote control. The electronic controller is preferably located within the housing of the power supply.

The above problems are also solved by a wheelchair, in particular a manual wheelchair, with a wheelchair footrest according to the invention. The advantages mentioned above are also achieved by means of such a wheelchair. In particular, the wheelchair with the special wheelchair footrest illuminates the floor area in the forward direction of the wheelchair. This enables the wheelchair user to detect uneven surfaces or obstacles on the road in front of him, even in poor visibility conditions, and to adapt his driving style accordingly in order to avoid accidents.

Preferably, the wheelchair further comprises at least one further LED light strip, wherein the further LED light strip emits in particular red light and is arranged in such a way that it emits light from the back of the manual wheelchair to the rear. The further LED light strip is preferably located on the back side of the wheelchair. It is preferably positioned at the height of the wheelchair seat or above in order to emit its light to a large distance. The light is red to indicate that it is the back side of a vehicle.

SHORT DESCRIPTION OF THE DRAWINGS

In the following, the preferred embodiments of the present invention are described by means of the attached figures. It shows:

DETAILED DESCRIPTION OF PREFERRED EMBODIMENTS

In the following, preferred embodiments of the present invention are described in detail with reference to the attached figures.

Figure 1:
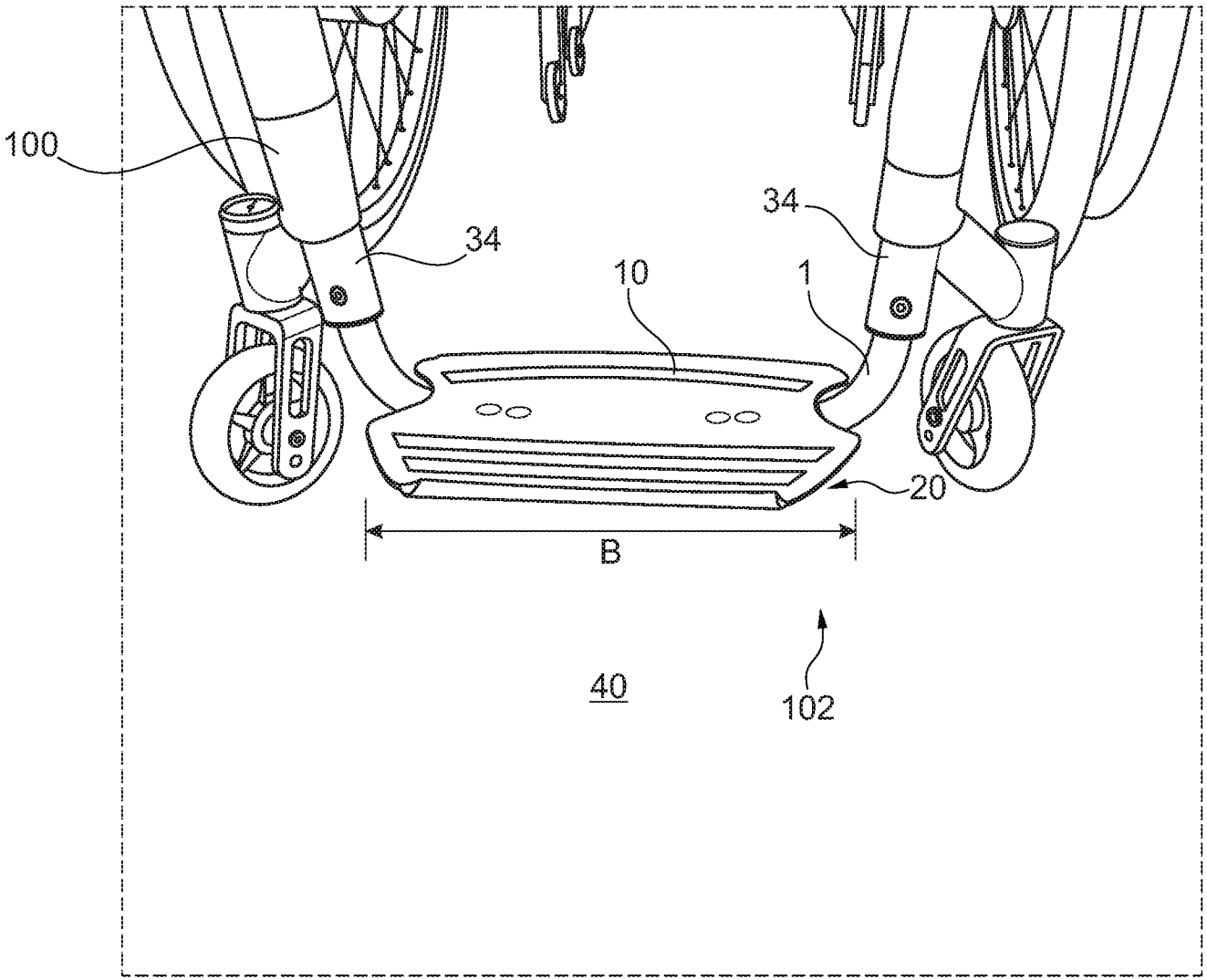
FIG. 1 is a perspective view from the front of an embodiment of the wheelchair footrest.

FIG. 1 shows a partial view of the front side 102 of a wheelchair 100 with a wheelchair footrest 1. This partial view shows two vertical frame parts 34 which are connected at their lower ends by a horizontal frame part 30. The horizontal frame part 30 can be moved in relation to the two vertical frame parts 34. This allows the height of the horizontal frame section 30 to be adjusted in relation to the floor area or the wheelchair seat 106 and thus to be adapted to the size of the wheelchair user.

Figure 2:
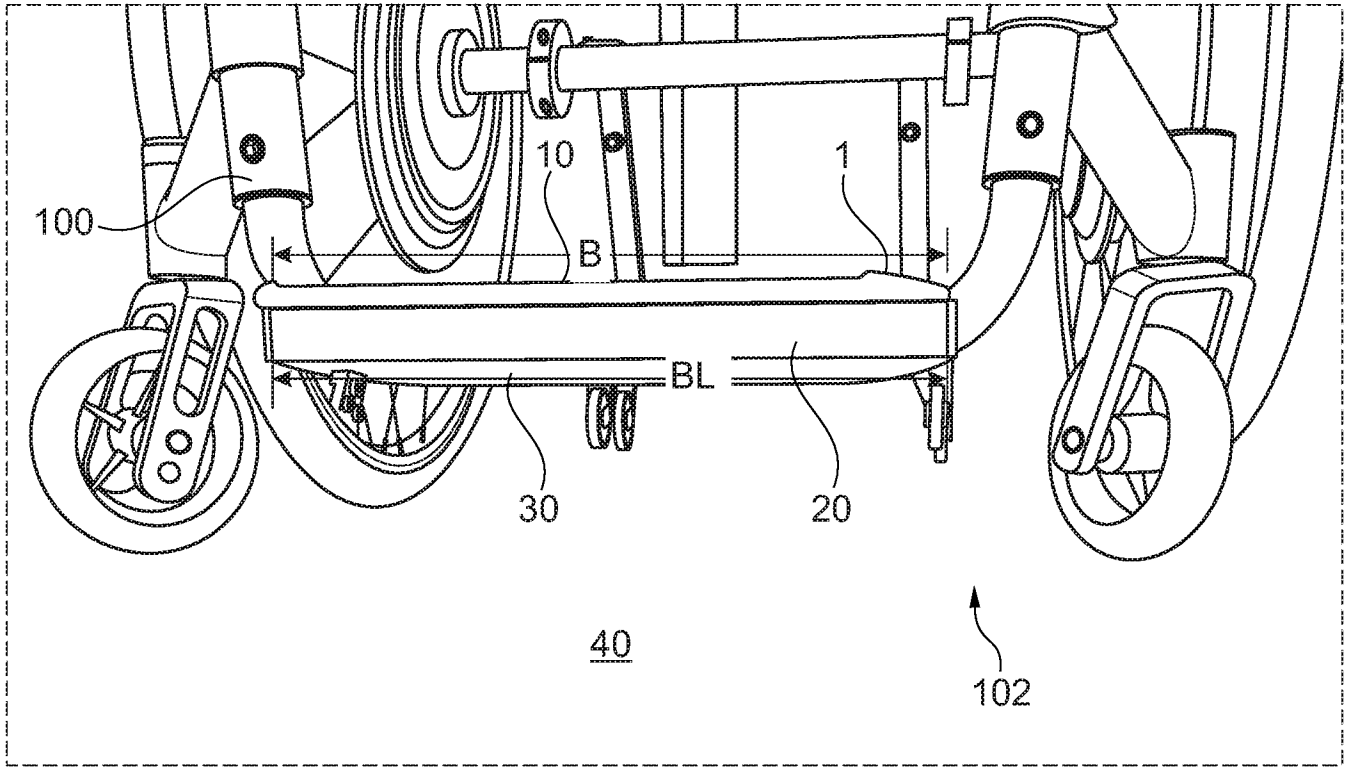
FIG. 2 is a frontal view of the embodiment of the wheelchair footrest of FIG. 1.
Figure 3:
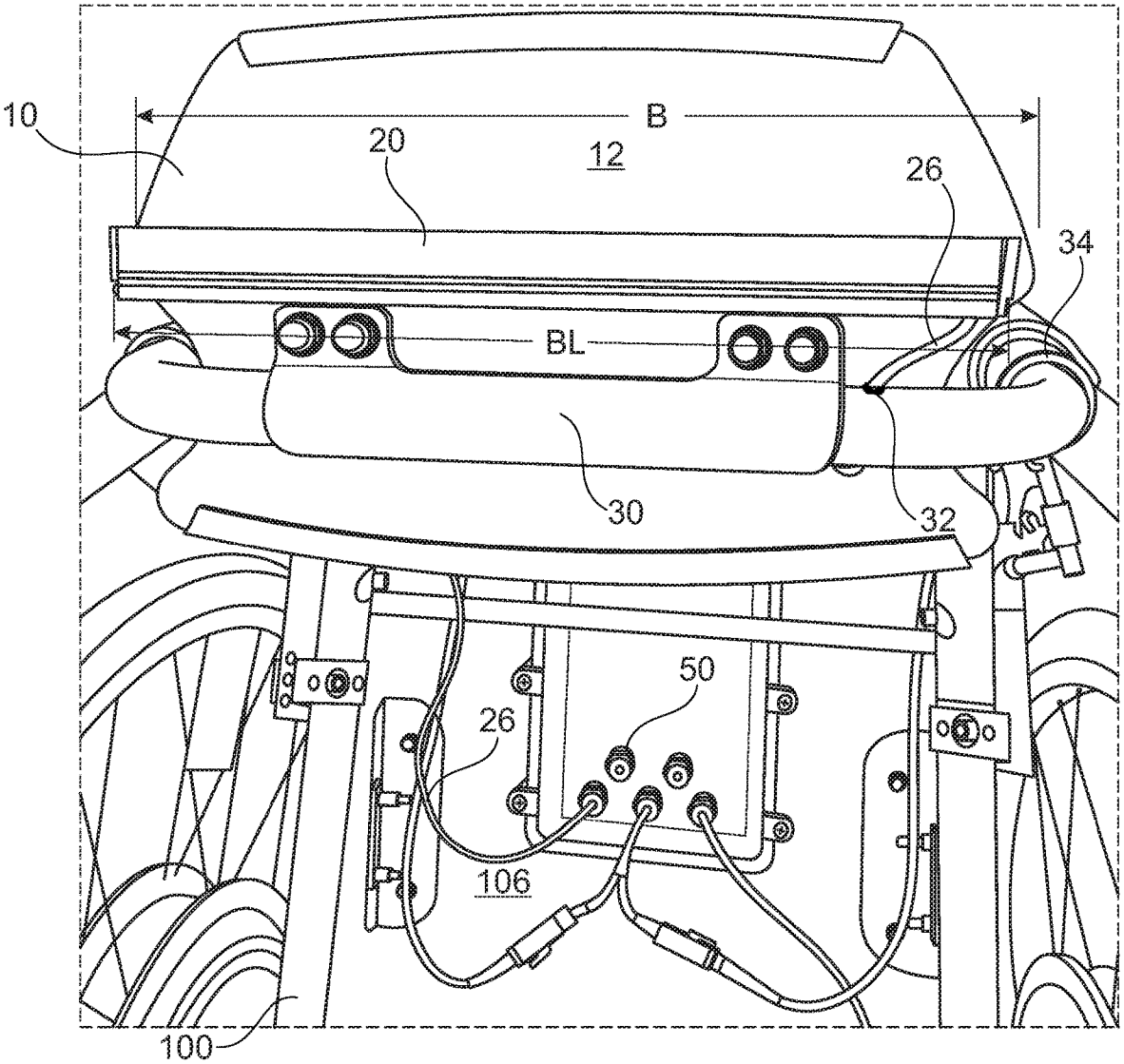
FIG. 3 is a view from below of the embodiment of the wheelchair footrest of FIG. 1.

In the embodiment of the wheelchair footrest 1 shown in FIGS. 1-3, an essentially rectangular foot support 10 is firmly attached to the horizontal frame part 30. The foot support 10 is firmly connected to the horizontal frame part 30 on its underside 12 with common fasteners such as screws or clamps. The foot support 10 preferably consists of a resistant material such as hard plastic, wood, carbon or metal and is shock- and/or waterproof.

Furthermore, on the underside 12 of the foot support 10 there is permanently attached a lighting means 20 in the form of an LED strip 20. As can be seen from FIG. 2, the lighting means 20 preferably extends along the width B of the foot support 10 and has highly luminous LED lamps 22, which are grouped together as an elongated LED strip 20. When switched on, the lighting means 20 illuminates a floor area 40 on the front 102 of the wheelchair 100 (see FIG. 1). The light is preferably white light in order to achieve a bright illumination of the floor area 40. LED lamps 22 can be both white LED lamps and RGB LED lamps. Depending on requirements, a very bright white light or a colored light of any color can be emitted from the LED strip 20.

The lighting means 20 is recessed from the front edge of the foot support 10 to protect the lighting means 20 from damage from the front and/or top by means of the foot support 10. The lighting means 20 is firmly attached to the underside 12 of the foot support 10, preferably by gluing, screwing or another method of fastening.

The lighting means 20 also has a solid housing, in particular out of aluminum, in which the individual LED lamps 22 are encapsulated to be shockproof and waterproof. The height of the lighting means 20 in one version corresponds at most to the diameter of the horizontal frame part 30. As a result, the lighting means 20 does not protrude downwards beyond the horizontal frame part 30 and is thus also protected against possible damage from below, e.g. in the event of unintentional contact with the ground. Preferably, the housing of the lighting means 20 comprises an extruded aluminum profile which is open towards the front.

The individual LED lamps 22 are preferably arranged side by side along the width BL of the lighting means 20. In one version, for example, 20-40 LED lamps 22 are arranged in one lighting means 20.

Figure 4:
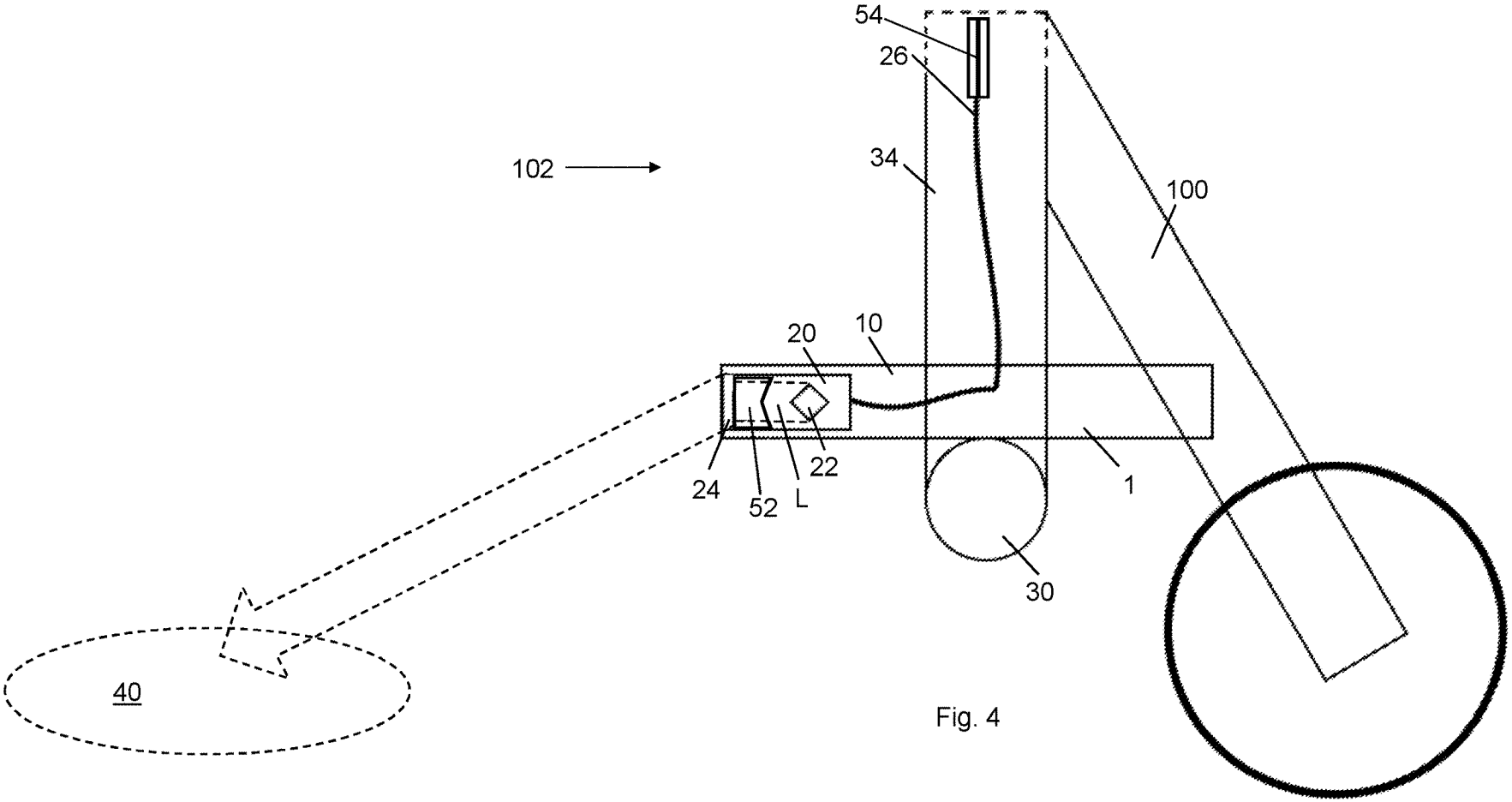
FIG. 4 is a schematic side view of an embodiment of a wheelchair footrest showing details of the LED strip.

In addition, the lighting means 20 may have a diffuser sheet 24 on the front side 102, as schematically shown in FIG. 4. The diffuser sheet 24 is a thin matt plastic foil and scatters the light L of the individual LED lamps 22. The diffuser sheet 24 thus enables a uniform illumination of the floor area 40 on the front side 102 of the wheelchair 100. In place of or in addition to the diffuser sheet 24, optics 52 can also be used to direct the light that would be emitted upwards from the LED strip 20 downwards onto the road, as shown in FIG. 4. This prevents glare to other road users and illuminates the road better. The optics 52 can also consist of a milky colored plastic to combine the advantages of a diffuser sheet 24 with the directional effect of the optics 52. The optics 52 preferably consist of an injection-molded profile made of transparent plastic, preferably PMMA, which is attached to the front side of the aluminum profile of the lighting means 20 to direct the light beams of the LED lamps 22 forwards and downwards.

In addition, lighting means 20 is connected via a cable connection 26 to a power supply 50 at wheelchair 100, as shown in FIGS. 3 and 4. The cable connection 26 can run at least partially within the frame 30, 34 of the wheelchair 100. Thus, the cable connection 26 is protected against damage by the frame 30, 34. In one embodiment, there is a cable opening 32 in the horizontal frame part 30, which allows the cable connection 26 to be easily routed into the frame 30, 34. The cable connection can be loose or guided inside the frame 30, 34 of the wheelchair 100. The length of the cable connection 26 is sufficient to ensure a secure power supply for each position of the height-adjustable horizontal frame section 30.

In the embodiment of FIG. 4, the lighting means is only illustratively integrated into the foot support 10 of the wheelchair footrest 1 so that it can radiate light L forward. Also in this embodiment, a number of LED lamps 22 are preferably used, which are arranged in a long extending row in the foot support 10. Preferably, an LED strip 20 with aluminum housing as described above can also be installed or injection molded into the foot support 10.

In another embodiment (not shown) there is a cable connection 26 from the lighting means 20 to a sliding contact 54 on or in the frame 30, 34 of the wheelchair 100. The sliding contact 54 enables an electrical connection between the height-adjustable horizontal frame part 30 and at least one of the two vertical frame parts 34. From the sliding contact 54 there is then a cable connection 26 to the power supply 50.

The cable connection 26 leads generally from the lighting means 20 to a power supply 50 at the wheelchair 100 to supply the lighting means 20 with electricity. The power supply 50 is in one embodiment an accumulator, which is detachably connected to the wheelchair 100 and can be detached from the wheelchair 100 especially for charging. In another embodiment, the power supply 50 can also be provided by means of a permanently installed accumulator. The permanently installed accumulator is charged by connecting a charging cable from an external power source to it.

The power supply 50 is preferably located on the underside of the wheelchair seat 106. This protects the power supply 50 from weather influences such as rain or direct sunlight. The power supply 50 can be detachably attached to the wheelchair 100 in one version, e.g. by clipping and/or screwing. In addition, the cable connection 26 is detachable, e.g. via screw connections, and connected to the power supply 50 in order to make it easy to replace the cable connection 26 and/or the power supply 50.

Figure 5:
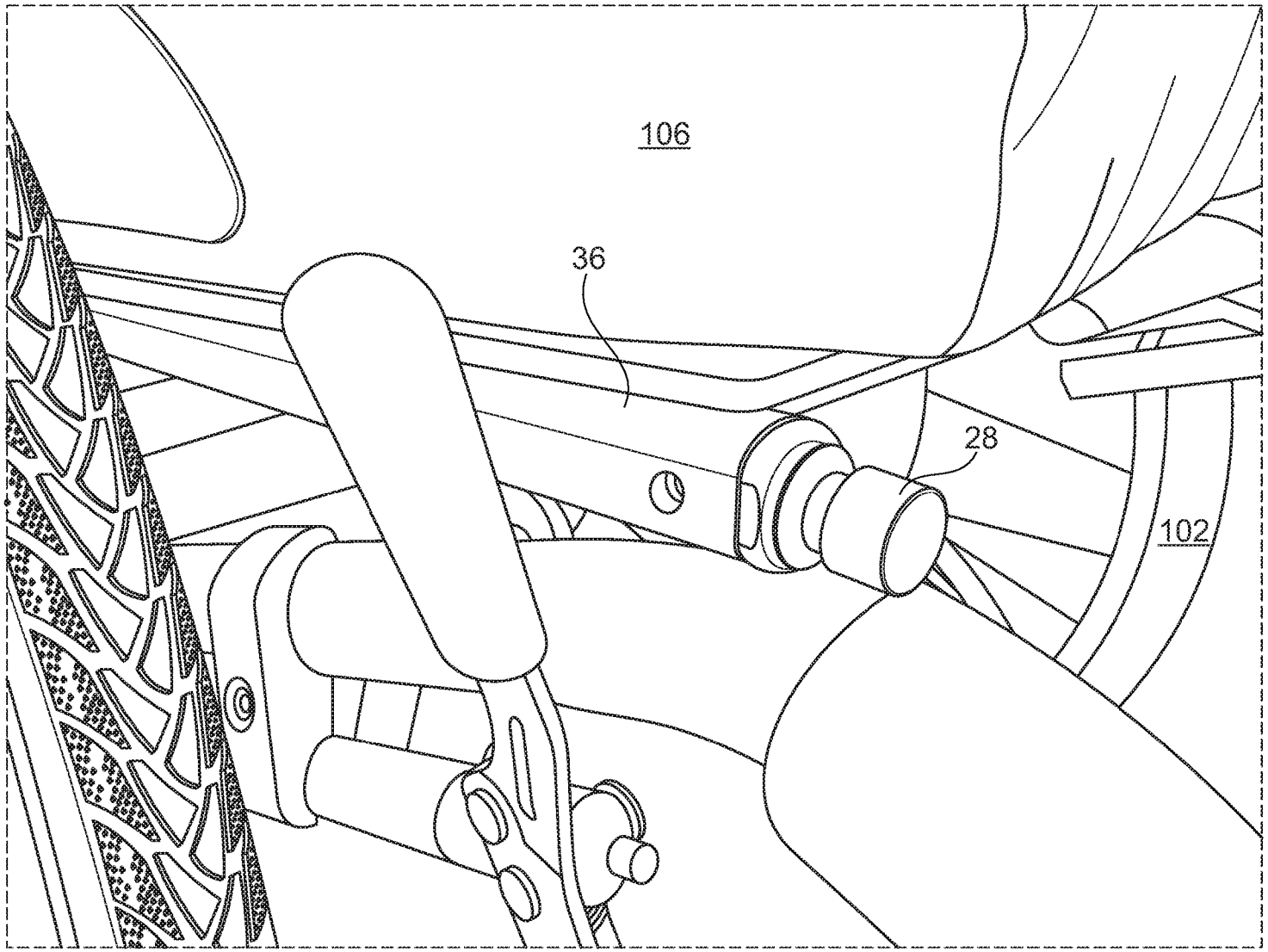
FIG. 5 is a perspective side view of a part of an embodiment of a wheelchair.
Figure 6:
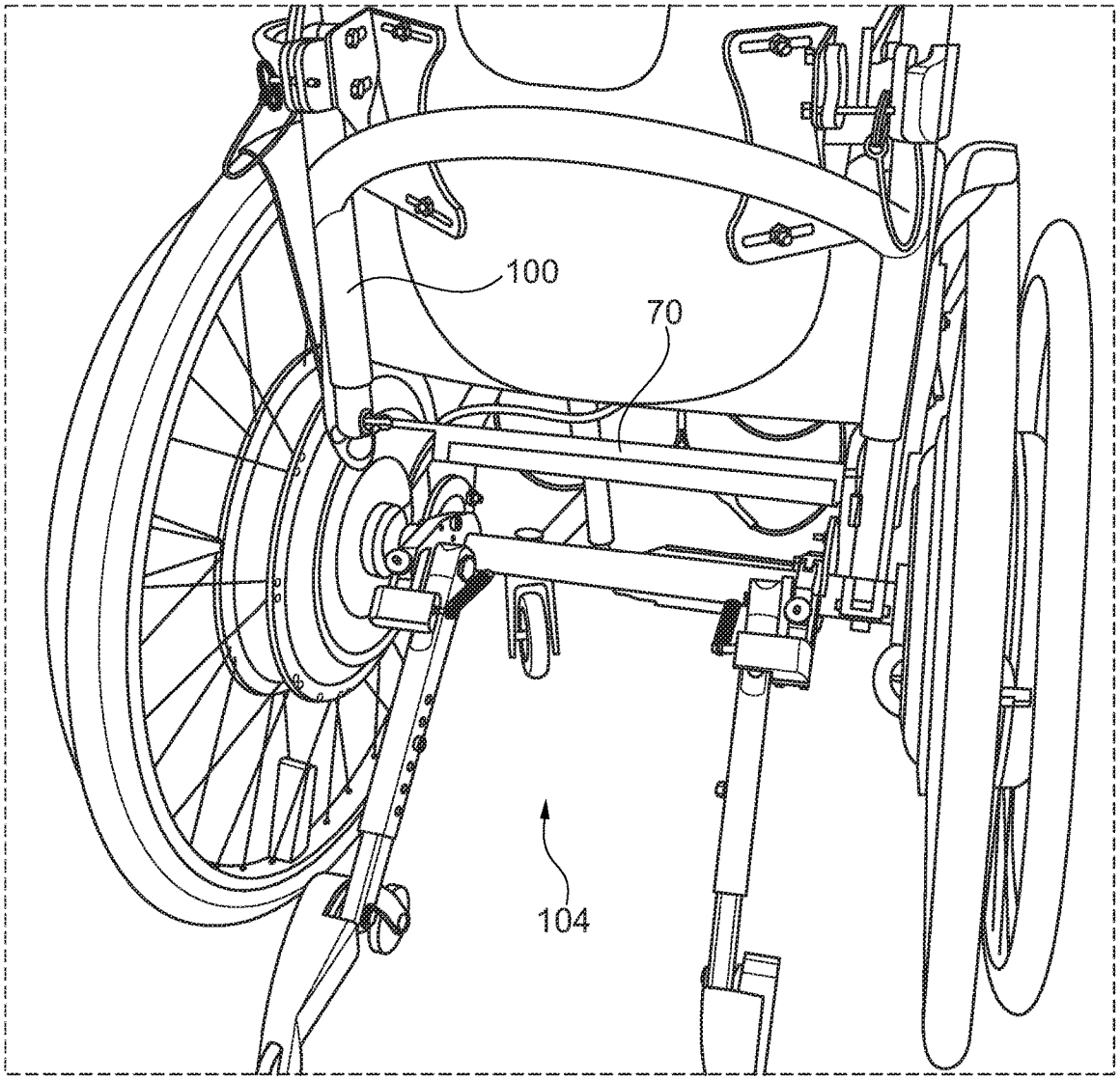
FIG. 6 is a rear view of the embodiment of the wheelchair of FIG. 5.

FIG. 5 shows a perspective partial view of the front side 102 of the wheelchair 100 at the height of the wheelchair seat 106. A switch 28 for activating or deactivating the lighting means 20 is attached to the front side of a frame part 36 of the wheelchair 100 and replaces a plastic plug. Switch 28 can be actuated, for example, by turning or pressing it.

By mounting the switch 28 at the height of the wheelchair seat 106, the switch 28 is easy and good to reach for the wheelchair user. A rapid switching-on/switching-off of the lighting means 20 as required is possible for the wheelchair user in an ergonomic way.

For mounting the switch 28, a plastic plug (not shown), usually used as a closure for frame part 36, is removed from the front of frame part 36. One end piece of the switch 28 has approximately the inner diameter of the frame part 36 and can thus be fixed in the frame part 36 by pressing it in. The cable connection 26 from the switch to the illuminant 20 as well as the power supply 50 runs inside the frame part 36.

In one embodiment, the wheelchair 100 has a further LED light strip 70 on its back side 104. This further LED light strip 70 preferably emits red light and serves for the recognition of the wheelchair 100. The red lighting is chosen to make it recognizable that it is the back side 104 of the wheelchair 100. For better visibility, the additional LED strip 70 is arranged at the height of the wheelchair seat 106 and emits red light directly to the rear. LED light strip 70 can also be equipped with a diffuser foil 24 to diffuse the light.

The LED light strip 70 is fixed between the frame parts of the wheelchair 100 and is also connected to the power supply 50 by wiring.

In the shown embodiment, the wheelchair footrest 1 has a continuous foot support 10 on which the wheelchair user can place both feet. This invention can, however, also be applied to wheelchair footrests 1, which have two separate foot supports 10, one for each foot. Such foot supports 10 can also be designed to be foldable.

Although certain illustrative embodiments and methods have been disclosed herein, it will be apparent from the foregoing disclosure to those skilled in the art that variations and modifications of such embodiments and methods may be made without departing from the invention. Accordingly, it is intended that the invention should be limited only to the extent required by the appended claims and the rules and principles of applicable law. Additionally, as used herein, references to direction such as "up" or "down" as well as recited materials or methods of attachment are intended to be exemplary and are not considered as limiting the invention and, unless otherwise specifically defined, the terms "generally," "substantially," or "approximately" when used with mathematical concepts or measurements mean within 10 degrees of angle or within 10 percent of the measurement, whichever is greater. As used herein, a step of "providing" a structural element recited in a method claim means and includes obtaining, fabricating, purchasing, acquiring or otherwise gaining access to the structural element for performing the steps of the method. As used herein, the claim terms are to be given their broadest reasonable meaning unless a clear disavowal of that meaning appears in the record in substantially the following form ("As used herein the term _____ is defined to mean _____")

LIST OF REFERENCE SIGNS

1 wheelchair footrest
10 foot support
12 underside of the foot support
20 lighting means/LED strip
22 LED lamp
24 diffuser foil
26 cable connection
28 switch
30 horizontal frame part
32 cable opening
34 vertical frame part
36 frame section with switch
40 illuminated floor area
50 power supply
70 LED light strip on the rear side
100 wheelchair
102 front of the wheelchair
104 fear of the wheelchair
106 wheelchair seat
B width of footrest
BL width of the lighting means
L light

What is claimed is:

1. A wheelchair footrest (1), comprising:

a. at least one foot support (10) for supporting the feet of a user; and b. at least one lighting means (20);

c. the lighting means (20) is fixedly arranged on at least one of said at least one foot support (10) to illuminate at least a floor area (40) on a front side (102) of said wheelchair (100);

d. the lighting means (20) comprising a Light Emitting Diode (LED) strip which is rigidly attached to the underside (12) of the at least one foot support (10), the LED strip having a length (BL) which extends over at least 50% of the width (B) of the at least one foot support (10);

e. wherein the lighting means (20) further comprises optics (52) which direct light which would be emitting upwardly from the LED strip (20) downwardly onto the floor area (40).

2. The wheelchair footrest according to claim 1, wherein the lighting means (20) comprises LED lighting means (22).

3. The wheelchair footrest according to claim 2, where the LED strip (20) comprises white LED lamps (22) and/or RGB LED lamps (22).

4. The wheelchair footrest according to claim 1, wherein the lighting means (20) is shockproof and/or waterproof.

5. The wheelchair footrest according to claim 1, wherein the lighting means (20) further comprises a diffuser sheet (24).

6. The wheelchair footrest according to claim 1, further comprising a power supply (50) with an accumulator.

7. The wheelchair footrest according to claim 6, wherein the power supply (50) is arranged to be located on the underside of the wheelchair seat (106).

8. The wheelchair footrest according to claim 6, wherein the lighting means (20) being electrically connected to the power supply (50) via sliding contacts (54) arranged in or on the frame (30, 34) of the wheelchair (100).

9. The wheelchair footrest according to claim 6, further comprising a wiring (26) between the lighting means (20) and the power supply (50), wherein the wiring (26) being at least partially installed within the wheelchair frame (30, 34, 36).

10. The wheelchair footrest according to claim 1, further comprising an electric switch (28) installed at the end of a tubular frame part (36).

11. The wheelchair footrest according to claim 1, further comprising an electronic controller for controlling the lighting means (20), wherein the controller being controllable by means of an app on a smartphone or on a smartwatch or by means of a remote control.

12. A manual wheelchair, with a wheelchair footrest (1) according to claim 1.

13. The manual wheelchair according to claim 12, further comprising at least one further LED light strip (70) that emits a red light and is arranged such that it emits light from the back side (104) of the manual wheelchair (100) to the rear.

* * * * *